US006572103B1

(12) United States Patent
Tranquilla

(10) Patent No.: US 6,572,103 B1
(45) Date of Patent: Jun. 3, 2003

(54) METHOD AND SYSTEM FOR TRACKING DOCUMENT TRAILING EDGE POSITION

(75) Inventor: Michael N. Tranquilla, Livonia, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 10/004,127

(22) Filed: Dec. 4, 2001

(51) Int. Cl.[7] ..... B65H 7/02

(52) U.S. Cl. ..... 271/265.02; 271/265.01; 271/258.02; 271/259; 271/258.01; 271/110; 271/111; 271/270; 271/10.02

(58) Field of Search ..... 271/10.02, 10.05, 271/110, 111, 258.01, 259, 258.02, 265.01, 265.02, 270

(56) References Cited

U.S. PATENT DOCUMENTS 4,540,170 A * 9/1985 Masuda et al. ..... 271/259
5,462,267 A * 10/1995 Hori ..... 271/10.04
5,848,784 A 12/1998 Tranquilla
5,969,274 A * 10/1999 Johnson ..... 271/3.17
6,089,561 A * 7/2000 Marshall et al. ..... 271/10.03
6,199,854 B1 3/2001 Tranquilla et al.

FOREIGN PATENT DOCUMENTS

JP 57160846 A * 10/1982 ..... B65H/7/12

OTHER PUBLICATIONS

W.E. Church and J. D. Froula, Dynamic Sheet Length Sensing, Jul. 1975, IBM Technical Disclosure Bulletin, vol. 18 No. 2, 330 31.*

* cited by examiner

*Primary Examiner*—Donald P. Walsh
*Assistant Examiner*—Matthew Kohner
(74) *Attorney, Agent, or Firm*—Brooks & Kushman P.C.; Lise A. Rode; Mark T. Starr

(57) ABSTRACT

A method of tracking a document in a system for feeding and transporting documents includes detecting a document trailing edge at a fixed location upstream of a feeder. The system includes a feeder stage and a transport stage downstream of the feeder stage. The feeder stage includes the feeder and a separator. The method further includes tracking a position of the document trailing edge as the document trailing edge moves between the fixed location and the feeder, and performing an operation dependent on the document trailing edge position when the document trailing edge is between the fixed location and the feeder.

8 Claims, 1 Drawing Sheet

METHOD AND SYSTEM FOR TRACKING DOCUMENT TRAILING EDGE POSITION

CROSS-REFERENCE TO RELATED APPLICATIONS

The subject matter disclosed herein is related to the subject matter disclosed in U.S. Pat. Ser. No. 10/004,128 entitled "System and Method for Detecting a Document Trailing Edge Exiting Feeder," by Michael N. Tranquilla, filed Dec. 4, 2001, which is assigned to the assignee of the instant application, and the contents of which are incorporated by reference herein.

BACKGROUND OF THE INVENTION

1. Field of the Invention

The present invention relates to systems for feeding and transporting documents and to a method and system for tracking document trailing edge position.

2. Background Art

A typical system for feeding and transporting documents includes a feeder and a separator in the document feeding portion of the system, and a series of roller pairs or belts in the document transporting portion of the system. In the feeding portion of the system, the feeder acts with the separator to feed documents singly, in order, from a stack. In the transporting portion of the system, the roller pairs and/or belts convey the documents, one at a time, past other processing devices such as readers, printers, and sorters that perform operations on the documents. The feeder is typically a feed wheel, but may take other forms. The separator may be a wheel, but also may take other forms such as a belt. Further, the components in the transporting portion of the system may take a variety of forms. Systems also include a component in the document feeding portion of the system that nudges documents into the nip between the feeder and the separator. A suitable nudger may be a nudger wheel, but may take other forms. An existing document feeder is shown in U.S. Pat. No. 6,199,854. That patent describes a document feeder with a variable speed separator.

In existing systems for feeding and transporting documents, operations that depend on the position of the document are generally performed in the transport stage, or transporting portion of the system For example, U.S. Pat. No. 5,848,784 describes a document separation apparatus. That patent describes the downstream acceleration/deceleration of documents with pinch rollers to adjust document spacing.

For the foregoing reasons, there is a need for a method and system for tracking document trailing edge position that allows operations that depend on the position of the document to be performed in the feeder stage, or feeding portion oft he system

SUMMARY OF THE INVENTION

It is, therefore, an object of the present invention to provide a method and system for tracking document trailing edge position that detects and tracks the trailing edge prior to the feeder.

In carrying out the above object, a method of tracking a document in a system for feeding and transporting documents is provided. The document has a leading edge and a trailing edge. The system includes a feeder stage and a transport stage downstream of the feeder stage. The feeder stage includes a feeder and a separator. The method comprises detecting the document trailing edge at a fixed location upstream of the feeder, and tracking a position of the document trailing edge as the document trailing edge moves between the fixed location and the feeder. The method further comprises performing an operation dependant on the document trailing edge position when the document trailing edge is between the fixed location and the feeder.

In a preferred embodiment, detecting further comprises providing a tachometer at the fixed location upstream of the feeder, and detecting a deceleration of the tachometer indicating when the document trailing edge passes the fixed location.

Tracking, in embodiments of the present invention, may take many forms. For example, the feeder may be a constant velocity feeder, and tracking would comprise starting a timer upon detection of the document trailing edge at the fixed location. For example, the feeder may include a tachometer that produces an output. Tracking would further comprise tracking the position of the document trailing edge based on the feeder tachometer output as the document trailing edge moves between the fixed location and the feeder. The feeder tachometer may include an encoder with the feeder tachometer output being a pulse sequence, or the feeder tachometer output may be an analog velocity signal.

Further, in carrying out the present invention, a system for feeding and transporting documents is provided. Each document has a leading edge and trailing edge. The system comprises a feeder stage including a feeder and a separator, a transport stage downstream of the feeder stage, and a tachometer at a fixed location upstream of the feeder. Control logic is configured to detect a deceleration of the tachometer indicating when the document trailing edge passes the fixed location The control logic is further configured to track a position of the document trailing edge as the document trailing edge moves between the fixed location and the feeder, and provides an output signal. The system further comprises a control device. The control device receives the output signal, and is configured to perform an operation dependent on the document trailing edge position when the document trailing edge is between the fixed location and the feeder.

Tracking, in embodiments of the present invention, may take many forms. For example, the feeder may be a constant velocity feeder with the control logic being further configured to start a timer upon detection of the document trailing edge at the fixed location. Further, for example, the feeder may include a tachometer that produces an output, and the control logic would be further configured to track the position of the document trailing edge based on the feeder tachometer output as the document trailing edge moves between the fixed location and the feeder. The feeder tachometer may include an encoder with the feeder tachometer output being a pulse sequence, or the feeder tachometer output may be an analog velocity signal.

The advantages associated with embodiments of the present invention are numerous. For example, embodiments of the present invention provide methods and systems for tracking document trailing edge position prior to the trailing edge reaching the feed wheel. Tracking the trailing edge position while the document is still in the feeder allows operations to be performed on the document, as well as other operations to be performed while the document is still in the feeder. In addition, knowing the trailing edge position allows a system to know when to perform operations on subsequent documents. Many document processing products could benefit from embodiments of the present invention. For example, copiers, fax machines, sheet feeders for computer printers, automatic teller machines, and document image scanners are just a few examples of products that could benefit from embodiments of the present invention.

The above object and other objects, features, and advantages of the present invention are readily apparent from the following detailed description of the preferred embodiment when taken in connection with the accompanying drawings

DETAILED DESCRIPTION OF THE PREFERRED EMBODIMENT

Figure 1:
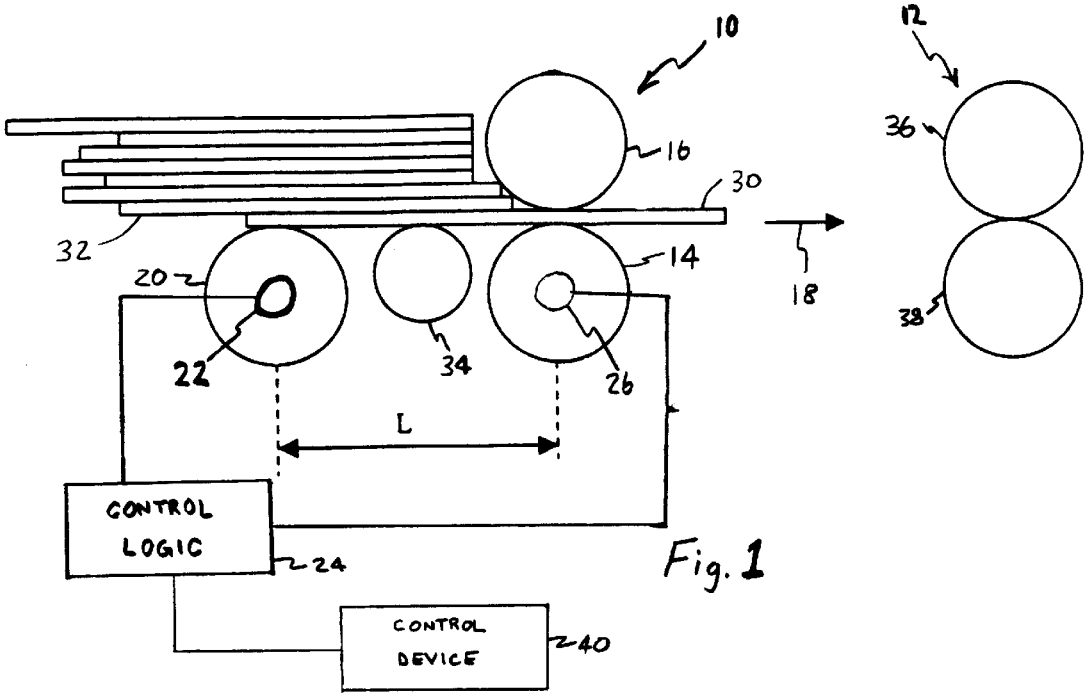
FIG. 1 illustrates a system for feeding and transporting documents according to a preferred embodiment of the present invention.

FIG. 1 illustrates a system for feeding and transporting documents. The system includes a feeder stage 10 and a transport stage 12. Feeder stage 10 includes a feeder 14 and a separator 16. Transport stage 12 is downstream of feeder stage 10, with arrow 18 pointing in the downstream direction. A document leading edge is the more downstream edge while the trailing edge is the more upstream edge. A wheel 20 and a tachometer 22 are at a fixed location upstream of feeder 14. Tachometer 22 provides an output to control logic 24. Control logic 24 is configured to detect a deceleration of tachometer 22 indicating when a document trailing edge passes the fixed location. Control logic 24 is configured to track a position of the document trailing edge as the document trailing edge moves between the fixed location and feeder 14. Control logic 24 also provides an output signal. A control device 40 receives the output signal from control logic 24, and is configured to perform an operation dependent on the document trailing edge position when the document trailing edge is between the fixed location and feeder 14. The document stack is shown adjacent separator 16 and includes first document 30 and second document 32 among other documents in the stack, with the trailing edge of first document 30 being near wheel 20.

The components shown in FIG. 1 are preferred, and alternative arrangements are possible. For example, the feeder is shown as a feed wheel 14, but may take other forms. The separator is shown as a separator wheel 16, but also may take other forms such as a belt. As shown, feed wheel 14 rotates clockwise, driven by its own motor, and separator or retarder wheel 16 is fixed or runs slowly. Further, the components in transporting portion 12 may take a variety of forms and are shown as an accelerator idler wheel 36 and an accelerator drive wheel 38 that rotates clockwise. In a preferred embodiment, the system includes a suitable nudging device such as nudger wheel 34. Further, tachometer 22 may be implemented in any suitable way.

With continuing reference to FIG. 1 in which a preferred embodiment of a system for feeding and transporting documents is illustrated, feed wheel 14, separator 16, and nudger 34 are typical elements for feeding documents singly from a document stack. Downstream accelerator wheel pair 36 and 38 accept the document from feed wheel 14 and separator 16. The accelerator drive wheel 38 may or may not be driven by the same motor that drives feed wheel 14. The accelerator drive wheel 38 may run at the same or higher peripheral speed than feed wheel 14. Feed wheel 14 may or may not have a greater grip on the document than the accelerator wheel pair, depending upon the application. Feed wheel 14 may or may not have attached to it a device to indicate relative feed wheel position.

FIG. 1 shows the addition of a tachometer 22 or speed measuring device driven by first document 30 while it is in the feeder. Tachometer wheel 20 will decelerate when the trailing edge of first document 30 moves past the nip between tachometer wheel 20 and second document 32. The detection of this deceleration indicates the position of the trailing edge of first document 30. It is preferred to have tachometer wheel 20 as far upstream of feeder 14 as possible so as to detect the trailing edge as early as possible. This enables the greatest potential for performing a variety of operations on the document before it leaves the feeder. The upstream distance L from the feeder is limited only by the minimum length of the document that is being fed.

Because tachometer wheel 20 and tachometer 22 form a device that converts velocity to an electrical signal, the tachometer signal can be sent to electronics such as control logic 24 to perform the necessary measurements. There are no restrictions on the exact nature of the tachometer output signal. For example, the signal may be a signal proportional to velocity, such as occurs in analog tachometers. The signal may also be a signal representing velocity, such as a pulse sequence of an optical encoder. In either case, the signal is simply a signal that indicates that the tachometer has decelerated.

Figure 2:
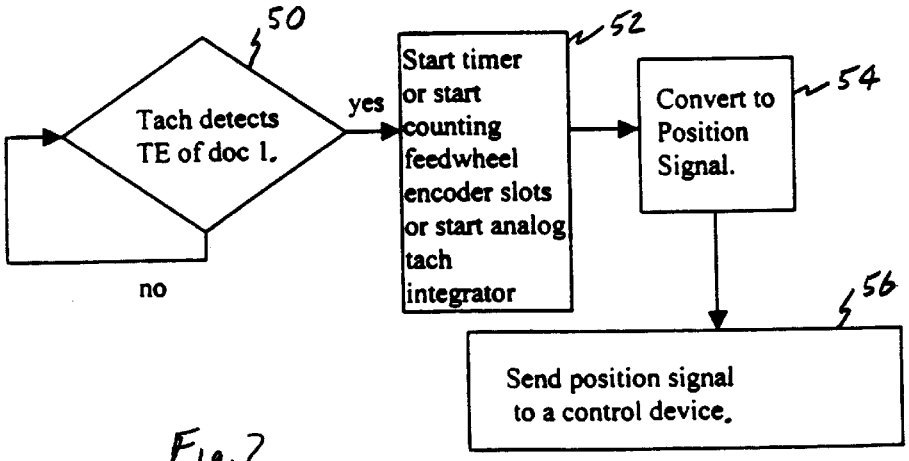
FIG. 2 illustrates a method of tracking documents in a system for feeding and transporting documents according to a preferred embodiment of the present invention.

In FIG. 2, a preferred embodiment of a method of tracking a document in a system for feeding and transporting documents is illustrated. Each document has a leading edge and a trailing edge, with the leading edge being the downstream edge and the trailing edge being the upstream edge. The system includes a feeder stage and a transport stage downstream of the feeder stage and in a preferred embodiment is the system shown in FIG. 1.

In the method, the document trailing edge is detected at a fixed location upstream of the feeder. In the preferred embodiment, block 50 indicates that tachometer wheel 20 and tachometer 22 detect the trailing edge of first document 30. After detection, the method comprehends tracking a position of the document trailing edge as the document trailing edge moves between the fixed location and feeder 14. In the preferred embodiment, blocks 52 and 54 illustrate the tracking. At block 56, a position signal is sent to control device 40 and an operation dependent on the document trailing edge position is performed when the document trailing edge is between the fixed location and feeder 14.

More specifically, in a preferred embodiment as illustrated in FIG. 2, the trailing edge detection algorithm constantly looks for a deceleration at the tachometer wheel 20. When detected, a signal is sent to another functional electronic block that performs tracking by either starting a timer when feeder 14 is a constant velocity feeder, starting counting feed wheel encoder pulses when feeder 14 includes a feeder tachometer 26 including an encoder and producing an output as a pulse sequence, or starting an electronic integrator when feeder 14 includes a feeder tachometer 26 with an analog velocity signal output.

In the case of a feeder with a known, constant feed wheel velocity, a timer value after document 30 trailing edge detection represents the position of the trailing edge from the tachometer wheel 20/second document 32 nip. If feed wheel 14 is equipped with an encoder, the encoder pulse count after document 30 trailing edge detection represents the position of the trailing edge from the tachometer wheel 20/second document 32 nip, whether or not the feed wheel is running at known, constant velocity. If feed wheel 14 is equipped with an analog tachometer, the position of the trailing edge is calculated by integrating the analog tachometer signal at the start of document 30 trailing edge detection with either a digital or analog computer. That is, tracking may be performed in systems and methods of the present invention in a variety of ways with examples being given above.

Block 54 of FIG. 2 converts timer values, encoder counts, or integrator values into position values. These position values may be either digital or analog. The position signal is sent to one or more control devices 40 that will initiate operations when the trailing edge of document 30 arrives at certain locations. Examples of these operations may be, but are not limited to: stop nudger 34 when the trailing edge is between nudger 34 and feeder 14, accelerate the document with the accelerator wheel pair 36 and 38 after the trailing edge has left the feeder, relieve pinch pressure from nudger 34 when it is not needed, and stop or slow feed wheel 14 when the trailing edge has left the feeder to create space between documents.

It is appreciated by those skilled in the art that FIGS. 1 and 2 illustrate preferred embodiments of a method and system of the present invention and that various alterations may be made to the system and method illustrated. For example, the feeder and separator may take other forms besides the illustrated feed wheel 14 and separator wheel 16. The transporting portion 12 of the system may take other forms besides roller pair 36 and 38, such as belts to convey the documents. Nudger 34 may also take a different form than that illustrated. Further, systems of the present invention utilize a tachometer 22 that may take other forms than the illustrated example. Further, various techniques for tracking document trailing edge position may be used (for example, a timer, a feeder encoder or feeder digital tachometer, or a feeder analog tachometer). Further, a preferred embodiment of a method of the present invention utilizes a tachometer where other techniques may be utilized for detecting the document trailing edge at a fixed location upstream of the feeder.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of tracking a document in a system for feeding and transporting documents, the document having a leading edge and a trailing edge, the system including a feeder stage and a transport stage downstream of the feeder stage, the feeder stage including a constant velocity feeder and a separate, the method comprising:

detecting the document trailing edge at a fixed location upstream of the feeder, wherein the detecting step includes the substeps of:

providing a tachometer at the fixed location upstream of the feeder; and, detecting a deceleration of the tachometer indicating when the document trailing edge passes the fixed location;

tracking a position of the document trailing edge as the document trailing edge moves between the fixed location and the feeder, wherein the tracking step includes starting a timer upon detection of the document trailing edge at the fixed location; and, performing an operation dependent on the document trailing edge position when the document trailing edge is between the fixed location and the feeder.

2. The method of claim 1 wherein the feeder includes a tachometer that produces an output, and wherein tracking further comprises:

tracking the position of the document trailing edge based on the feeder tachometer output as the document trailing edge moves between the fixed location and the feeder.

3. The method of claim 2 wherein the feeder tachometer includes an encoder, and the feeder tachometer output is a pulse sequence.

4. The method of claim 2 wherein the feeder tachometer output is an analog velocity signal.

5. A system for feeding and transporting documents, each document having a leading edge and a trailing edge, the system comprising:

a feeder stage including a constant velocity feeder and a separator;

a transport stage downstream of the feeder stage;

a tachometer at a fixed location upstream of the feeder;

control logic configured to detect a deceleration of the tachometer indicating when the document trailing edge passes the fixed location, to track a position of the document trailing edge as the document trailing edge moves between the fixed location and the feeder, and to start a timer upon detection of the document trailing edge at the fixed location, the control logic providing an output signal; and, a control device receiving the output signal, and being configured to perform an operation dependent on the document trailing edge position when the document trailing edge is between the fixed location and the feeder.

6. The system of claim 5 wherein the feeder includes a tachometer that produces an output, and wherein the control logic is further configured to track the position of the document trailing edge based on the feeder tachometer output as the document trailing edge moves between the fixed location and the feeder.

7. The system of claim 6 wherein the feeder tachometer includes an encoder, and the feeder tachometer output is a pulse sequence.

8. The system of claim 6 wherein the feeder tachometer output is an analog velocity signal.

* * * * *